United States Patent [19]

Stanich et al.

[11] Patent Number: 4,766,783

[45] Date of Patent: Aug. 30, 1988

[54] EXTENSION DEVICE FOR POWER SCREWDRIVER

[76] Inventors: Louis Stanich, 34 McNicoll Ave., Willowdale, Ontario, Canada, M24 2A8; Henry D. Sweeny, 152 Stoneybrook Dr., Kitchener, Ontario, Canada, N2M 4L7

[21] Appl. No.: 888,303

[22] Filed: Jul. 22, 1986

[51] Int. Cl.[4] ..... B25B 21/00

[52] U.S. Cl. ..... 81/54; 81/177.2

[58] Field of Search ..... 81/54, 57.11–57.14, 81/436, 467, 469, 177.2, 177.1, 180.1; 408/226, 705

[56] References Cited

U.S. PATENT DOCUMENTS 3,822,960 7/1974 Degen ..... 408/226
4,030,383 6/1977 Wagner ..... 81/54

FOREIGN PATENT DOCUMENTS 2129353 5/1984 United Kingdom ..... 81/54

*Primary Examiner*—Debra Meislin
*Attorney, Agent, or Firm*—Jones, Tullar & Cooper

[57] ABSTRACT

A device is provided for increasing the distance between the power head and bit of a power screwdriver, particularly one intended for driving drywall screws. The device includes a polygonal drive rod which replaces the original drive rod in the tool's clutch mechanism, a cylindrical sleeve which is press fit over the new drive rod and receives the original drive rod at the other end thereof, and a cylindrical adaptor which receives the sleeve internally and connects the clutch mechanism to the depth gauge of the tool, the bit still projecting from the depth gauge. Any number of the extension sets can be interconnected together to increase the extension length as desired. With the extension in use drywall screws can be driven in areas previously not accessible due to interference with the power head, and the operator can drive screws in ceilings while standing on the floor rather than on scaffolding.

6 Claims, 1 Drawing Sheet

34A
30A
26A
36
38
34
32
30
26
28
20
22
18
24
16
15
14
12
10
40
46
42
44
48

EXTENSION DEVICE FOR POWER SCREWDRIVER

The present invention relates generally to an accessory for use with a power tool such as a power drill or screwdriver and particularly to a device for extending the distance between a power tool and a bit for driving drywall screws into a receiving medium.

BACKGROUND AND SUMMARY OF THE INVENTION

There presently exist power tools specifically designed for driving drywall screws through a drywall panel into a receiving medium, such as a wooden stud, for securing the panel to the stud. The tool typically has a bit adapted to mate with the head of the screw, a depth gauge, a chuck for holding the bit, a clutch mechanism and a power unit. Normally the screw will be driven until the head is slightly below the surface of the panel, creating a "dimple" above the head which can be filled with drywall compound to hide the head from view. The clutch is usually preset to overrun at a specific torque and the torque is predetermined to be that required to drive the screw to the correct depth. When the clutch overruns, the operator knows that the screw has been driven properly.

In the majority of situations there is adequate clearance around the screws so that a power tool can be used in close proximity to the panel itself. There are other situations, however, where it is impossible to position the tool close to the panel and in such instances it becomes necessary to drive screws by hand or to use drywall nails. Such a situation can exist, for example, where there is ductwork near a ceiling and an adjacent wall, making it impossible to drive screws into a wooden header of the adjacent wall.

Also, when driving screws into ceiling panels in most rooms the operator has to stand on a scaffold or use stilts to position his body close enough to the ceiling to drive the screws.

The present invention has been designed to overcome the problem of driving screws, particularly drywall screws, in hard-to-reach areas and from the floor to the ceiling. The invention provides an extension which can fit between the clutch and the depth gauge or bit of a drywall "gun" as described above, thereby increasing the distance between the bit and the power head. This permits positioning of the bit in areas otherwise too small to accept the power head and also permits an operator to drive ceiling screws while standing on the floor. The extension device is provided as a plurality of sets of discrete elements so that any number of sets can be combined together in achieve the desired length of extension.

In one particular embodiment for one popular type of drywall gun the basic set includes a hexagonal drive rod receivable in the chuck of the tool in place of the original drive rod, a cylindrical sleeve having a hexagonal bore therethrough for receiving the replacement drive rod at one end and the original drive rod at the other end, and a cylindrical adaptor receiving the sleeve therein and bridging the gap between the chuck and the depth gauge of the tool. Since the depth gauge is normally threaded to the chuck the adaptor will have a female thread at one end for attachment to the chuck and a male thread at the other end for attachment to the depth gauge. If a further extension is required another basic set could be attached to the outer end of the first set and the depth gauge attached thereto rather than to the first set.

In another embodiment the replacement drive rod and the sleeve could be incorporated into a single moulded piece having a sleeve portion, a hexagonal projection at one end and a hexagonal bore at the other end. The projection of one sleeve portion would be matable with the hexagonal bore of an adjacent sleeve portion when multiple extensions are used.

Accordingly therefore, the present invention provides an extension device for increasing the distance between a power means and a bit means of apparatus for driving screws into a receiving medium, the apparatus including polygonal drive means connected to the power means and to the bit means, the device comprising: polygonal extension means connectable to the power means in place of the drive means; sleeve means for receiving the extension means at one end and the drive means at the other end thereof; and adaptor means for receiving the sleeve means therein and adapted to be connected to the power means at one end thereof.

DESCRIPTION OF THE PREFERRED EMBODIMENT

Figures 1, 2:
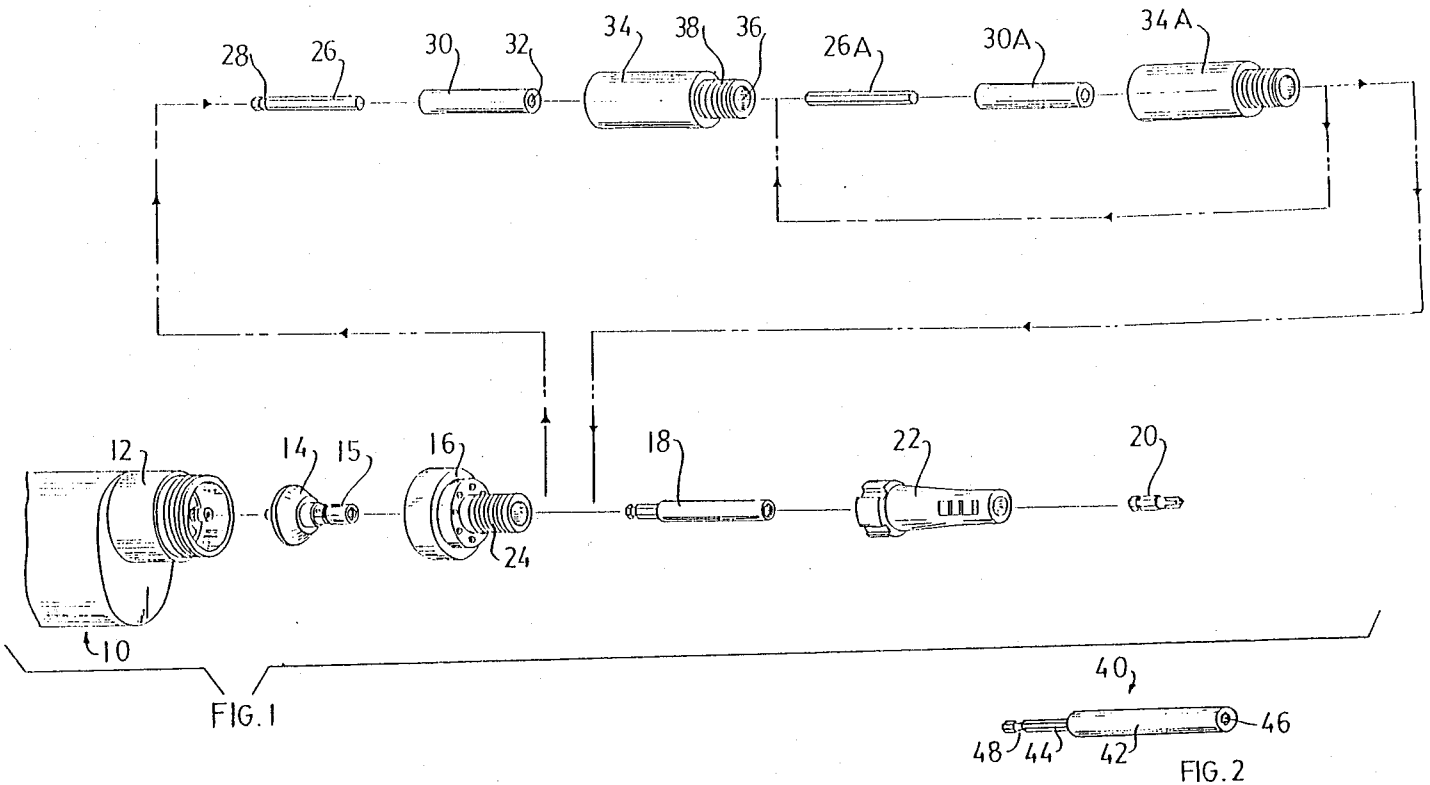
FIG. 1 shows in exploded view the components of the present invention and their relationship to a commercially available power tool.
FIG. 2 shows a one-piece sleeve and rod device for use in another embodiment of the invention.

The lower half of FIG. 1 shows, in exploded view, the usual components of a commerically available power tool for driving drywall screws into a receiving medium. The tool 10 includes a power head 12 containing an electric motor, a clutch 14 receivable in the power head and including a chuck portion 15. A cover 16 is threadably received on power head 12 and includes a threaded portion 24 to which depth gauge 22 is connected. The chuck portion 15 receives internally a hexagonal drive rod 18 which in turn has a hexagonal recess at the other end for receiving a drive bit 20. Depth gauge 16 is threadedly attached to the external threads 24 of the cover 16, to hold and properly support and center the drive bit and to set the depth of "dimple" for the screw.

The upper half of FIG. 1 illustrates two sets of the extension device of the present invention, it being understood that any number of sets can be assembled together to achieve the desired length of extension.

Each set is made up of three components, each being about the same length, say about 2 inches. First of all there is a hexagonal drive rod 26 which is adapted to be received in the chuck portion 15. The drive rod 26 of the basic set can have a circumferential groove 28 at one end for reception of a locking detent within the chuck portion. The next component of the invention is a cylindrical sleeve 30 having a hexagonal through bore 32 adapted to receive the rod 26 in a press fit therewith. Sleeve 30 is preferably extruded from a polymeric plastic material. The last component of the invention is a cylindrical external adaptor 34 provided with a cylindrical through bore 36 which can receive the sleeve 30 therein. At one end the adaptor has an internal female thread (not shown) for threaded reception of the cover thread 24 and at the other end the adaptor has an external male thread 38 for mating with the internal female thread (not shown) of the depth gauge 22. The adaptor 30 is preferably molded from a strong hard plastic material.

In order to use the basic set of this invention the operator first of all disconnects the depth gauge 22 from the cover 16 by breaking the threaded connection as at 24. He then pulls the drive rod 18 from the chuck portion 15 and inserts, in its place, the drive rod 26 of the invention. The end of the drive rod 18 previously inserted in the chuck portion 15 is press fit into one end of a sleeve 30 and the sleeve is then press fit over the drive rod 26. In order to achieve proper rigidity for torque transmission and to ensure that the parts are of the proper overall length the ends of the drive rods 18,26 must butt each other within the sleeve 30.

The adaptor 34 is then slid over the sleeve 30 and is threaded to the cover as at 24. The bit 20 is connected to the drive rod 18 and the depth gauge 22 is connected to the threaded end 38 of the adaptor 34 to complete the assembly. By adding the basic set to the power tool 10 the distance between the bit 20 and the power head 12 has been increased by the length of the set and the operator has more maneuverability with respect to the driving of the screws.

If a further extension is required another set or sets of drive rod, sleeve and adaptor can be connected in series to the basic set. The drawing shows one additional set comprising a drive rod 26A, a sleeve 30A and an adaptor 34A which can be connected to the basic set in the same manner as the basic set is connected to the power tool 10. The drive rod 26A would interconnect the sleeves 30 and 30A and the drive rod 18 would then be connected to the sleeve 30A rather than to the sleeve 30. Adaptor 34A would interconnect adaptor 30 and the depth gauge 22.

Drive rod 26A need not have a circumferential groove such as 28 therein, thereby simplifying the manufacturing process, although operation of the invention would not be affected if it did have such a groove.

FIG. 2 shows an alternative to the embodiment as described hereinabove. In FIG. 2 there is illustrated a one-piece unit 40 which has a sleeve portion 42 and a hexagonal extension 44 integrally formed therewith at one end. At the other end the sleeve has a blind hexagonal bore 46 therein. This units replaces the individual rods 26 and sleeves 30 of the first embodiment. It is clear that with the second embodiment the extension 44 is receivable in the chuck portion 15 of the tool and that either the hexagonal portion of the drive rod 18 or another extension 44 is receivable in the blind bore 46. Adaptors 34 as previously described would still be used between the cover 16 and the depth gauge 22. The unit 40 could be advantageously molded from a polypropylene plastic material. If desired the extension 44 can have a circumferential groove 48 for reception of a locking spring or detent in the chuck portion 15 of the tool.

The present invention has been described with respect to a specific commercially available drywall "gun" and hence the means such as threads 24,36 for connecting the extension to the "gun" were designed for use with that tool. The principles of the invention are applicable to other commerically available drywall guns even though minor changes might be necessary to achieve proper torque transmission from the power head to the bit. Essentially the cross-section of the drive rods 26,26A and the bore 32 of the sleeves 30,30A should be polygonal and match that of the drive rod 18. Furthermore, the extension device of the invention may not fit between the chuck and depth gauge of each available power tool. It might be necessary, for example, to fit the extension between the power head and the chuck if the design of the tool makes it difficult to disconnect the depth gauge from the clutch cover. In any event, it is clear that modifications could be made to the structure of the present invention without departing from the principles thereof and hence the protection to be afforded the invention is to be determined from the claims appended hereto.

The embodiments of the invention in which an exclusive property or privilege is claimed are defined as follows:

1. In an apparatus for driving screws into a receiving medium, the apparatus normally including power means, bit means, polygonal drive means removably connecting said power means to said bit means and depth gauge means threadedly connected to said power means, the improvement comprising an extension device for increasing the distance between the power means and the bit means, said device comprising:

first elongated polygonal extension rod means connectable to said power means in place of the polygonal drive means;

first elongated cylindrical sleeve means having a polygonal bore therethrough for receiving said first extension rod means in a press fit at one end thereof;

first adapter means for receiving said first sleeve means therein, said first adapter means having threaded sections at each end thereof, one of said sections being adapted for threadedly connecting said first adapter means to said power means in place of said depth gauge means;

second elongated polygonal extension rod means connected to the other end of said first sleeve means;

second elongated cylindrical sleeve means having a polygonal bore therethrough for receiving said second extension rod means in a press fit at one end thereof and for receiving the polygonal drive means in a press fit at the other end thereof; and second adapter means for receiving said second sleeve means therein, said second adapter means having threaded sections at each end thereof, for threaded connection at one end thereof to the other end of said first adapter means, and at the other end thereof to said depth gauge means.

2. The improvement of claim 1 wherein said first rod means and sleeve means are integrally formed together and said second rod means and sleeve means are integrally formed together, with each rod means projecting from one end of its associated sleeve means and with each sleeve means having a polygonal blind bore at the other end thereof.

3. The improvement of claim 2 wherein each of said rod means and said drive means has a hexagonal cross-section and the blind bore in each of said sleeve means has a mating hexagonal cross-section.

4. The improvement of claim 1 wherein each of said rod means and said drive means has a hexagonal cross-section and the bore through each of said sleeve means has a mating hexagonal cross-section.

5. In an apparatus for driving screws into a receiving medium, the apparatus normally including power means, bit means, polygonal drive means removably connecting said power means to said bit means, and depth gauge means threadedly connected to said power means, the improvement comprising an extension device for increasing the distance between the power means and the bit means, said device comprising:

first elongated polygonal extension rod means connectable at a first end thereof to said power means in place of said polygonal drive means;

first elongated cylindrical sleeve means integrally formed with said first means at a second end thereof said first sleeve means having a polygonal blind bore therein at the end opposite said rod means;

first adapter means for receiving said first sleeve means therein, said first adapter means having threaded sections at each end thereof, one of said sections being adapted for threadedly connecting said first adapter means to said power means in place of said depth gauge means;

second elongated polygonal extension rod means having one end received in the blind bore of said first sleeve means;

second elongated cylindrical sleeve means integrally formed with said second rod means at the other end thereof, said second sleeve means having a polygonal blind bore therein at the end opposite said second rod means for receiving the polygonal drive means therein; and second adapter means for receiving said second sleeve means therein, said second adapter means having threaded sections at each end thereof, for threaded connection at one end thereof to the other end of said first adapter means, and at the other end thereof to said depth gauge means.

6. The improvement of claim 5 wherein each of said rod means and said drive means has a hexagonal cross-section and the blind bore in each of said sleeve means has a mating hexagonal cross-section.

* * * * *